US006216353B1

(12) United States Patent
Schenck

(10) Patent No.: US 6,216,353 B1
(45) Date of Patent: Apr. 17, 2001

(54) CENTERLINE DETECTOR FOR A TUBULAR KNIT FABRIC LAY CUTTER

(75) Inventor: James Moore Schenck, Winston-Salem, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 09/135,116

(22) Filed: Aug. 17, 1998

(51) Int. Cl.[7] ..... G01B 121/04; G01B 7/00; G01B 7/30

(52) U.S. Cl. ..... 33/520; 73/159; 700/134; 702/150

(58) Field of Search ..... 73/865.9, 865.8, 73/159; 33/520, 11, 343, 644, 534, 628; 26/7, 70; 700/134; 702/150, 151

(56) References Cited

U.S. PATENT DOCUMENTS

| | | | | |
|---|---|---|---|---|
| 2,376,879 | * | 5/1945 | Matthews et al. | 73/159 X |
| 2,615,334 | * | 10/1952 | Gift | 73/159 |
| 3,540,830 | * | 11/1970 | Di Canio | 73/159 X |
| 3,596,068 | * | 7/1971 | Doyle | 702/150 X |
| 3,769,714 | * | 11/1973 | Anderson | 33/520 |
| 3,962,730 | * | 6/1976 | Robinson | 73/159 X |
| 5,663,885 | * | 9/1997 | Stahl | 700/134 |
| 5,806,390 | * | 9/1998 | Pomerleau et al. | 700/134 X |

FOREIGN PATENT DOCUMENTS

| | | | | |
|---|---|---|---|---|
| 61-66116 | * | 4/1986 | (JP) | 33/520 |

* cited by examiner

*Primary Examiner*—Thomas P. Noland
(74) *Attorney, Agent, or Firm*—Rhodes & Mason, PLLC

(57) ABSTRACT

A centerline detector for a tubular knit fabric lay cutter table. The apparatus includes a nearside side edge compressor for determining the position of the nearside edge of the fabric lay and providing a signal representative of the nearside edge. The apparatus also includes a farside side edge compressor for determining the position of the farside edge of the fabric lay and providing a signal representative of the farside edge. A controller is connected to the nearside side edge compressor and the farside side edge compressor for receiving the signal representative of the nearside edge and the signal representative of the farside edge and calculating a first centerpoint of the fabric lay. In the preferred embodiment the centerline detector makes at least two measurements along a length of the fabric lay. The multiple measurements of the centerpoint of the fabric lay can then be used to calculate the centerline of the fabric lay between the two points as well as the centerline angle with respect to the edge of the cutter table. This information can be used by the cutter table to adjust the layout of the fabric garment pieces that the cutter will be used to cut.

22 Claims, 1 Drawing Sheet

CENTERLINE DETECTOR FOR A TUBULAR KNIT FABRIC LAY CUTTER

BACKGROUND OF THE INVENTION (1) Field of the Invention

The present invention relates generally to cutting systems for cutting a garment pattern from a tubular knit fabric lay and, more particularly, to a centerline detector for a tubular knit fabric lay cutter.

(2) Description of the Prior Art

Fabric cutting is typically performed on a multiplicity of fabric layers referred to as fabric plies. The multiplicity of fabric plies are vertically arranged to form a fabric lay which is moved into a cutting assembly for cutting the plies simultaneously according to a predetermined arrangement of fabric sections which may have varying size and shape.

Generally, the vertical arrangement of fabric plies produces a fabric lay with nonuniform edge alignment which results in fabric waste or nonuniform cut fabric sections. More particularly, for tubular knit fabric lays, the amount of edge waste and/or the number and probability of nonuniform cut fabric sections involving the folded edges is substantially increased.

Various prior art fabric cutting systems have attempted to measure and control the fabric longitudinal centerline with respect to the cutter in order to decrease the amount of edge waste due to nonuniform edge alignment within the fabric lays. Although the prior art has sought to decrease fabric waste due to section cut layout inefficiency via automated cutting systems which optimize section layout within a given fabric length, such prior art systems have relied upon manual measurement of the fabric edges and calculation of the fabric lay centerline therefrom, generally by interpolation between two points measured at predetermined fabric intervals. Fabric cutting patterns were then readjusted based upon those centerline values.

Fabric lay centerline points determined from prior art manual measurements of the nonuniform edges have typically produced centerline error in the range of +/−6 mm within a given fabric length. Particularly for tubular knit fabric lays where fabric sections are cut around the folded edges, fabric lay centerline measurement error is substantially increased because the amount of waste is magnified by at least a power of two for the edge cut sections. When, rarely, cuts are made with respect to both folds, the effect of the error increases to four times! Thus, 5 mm error on both folds of a matching front and back garment piece could result in a 20 mm error in the seam location. This error would be sufficient to produce a second quality, low profit garment.

One prior art alternative to centerline calculation involved fabric lay alignment along one edge of the fabric lay. While this method reduces the need for highly accurate centerline measurements, a substantial amount of waste is still produced along the nonaligned edge. For tubular knitted fabrics, further waste results because fabric section cutting may not be optimized without use of both folded edges.

Thus, there remains a need for a fabric lay centerline detector for automatically measuring and determining the centerline of a fabric lay, particularly for tubular knit fabric lays, whereby the centerline determination error is substantially reduced thereby decreasing fabric waste and folded edge cut section non-uniformity while, at the same time, can make an accurate measurement even when the fabric lay is covered by a plastic vacuum film.

SUMMARY OF THE INVENTION

The present invention is directed to a centerline detector for a tubular knit fabric lay cutter table. The apparatus includes a nearside side edge compressor for determining the position of the nearside edge of the fabric lay and providing a signal representative of the nearside edge. In the preferred embodiment the nearside compressor includes a first generally vertical movable paddle and an actuator for moving the first paddle against the nearside edge of the fabric lay at a predetermined pressure.

The apparatus also includes a farside side edge compressor for determining the position of the farside edge of the fabric lay and providing a signal representative of the farside edge. In the preferred embodiment, the farside compressor includes a second generally vertical movable paddle and an actuator for moving the second paddle against the farside edge of the fabric lay at substantially the same predetermined pressure as the first paddle.

A controller is connected to the nearside side edge compressor and the farside side edge compressor for receiving the signal representative of the nearside edge and the signal representative of the farside edge and calculating a first centerpoint of the fabric lay. In the preferred embodiment the centerline detector makes at least two measurements along a length of the fabric lay. The multiple measurements of the centerpoint of the fabric lay can then be used to calculate the centerline of the fabric lay between the two points as well as the centerline angle with respect to the edge of the cutter table. This information can be used by the cutter table to adjust the layout of the fabric garment pieces that the cutter will be used to cut.

Finally, in the preferred embodiment, a plastic film tucker upstream from the centerline detector tucks the edges of the plastic film against the nearside edge and the farside edge of the fabric lay to prevent interference with the operation of the centerline detector. The plastic film is generally placed over the fabric lay and a vacuum is applied prior to cutting since the combination of the plastic film and vacuum stabilizes the package and permits faster and more accurate cutting. However, the edges of the plastic film may "tent" adjacent to the edges of the fabric lay and, on occasion, interfere with the operation of the centerline detector. The tucker prevents the "tent" from forming.

Accordingly, one aspect of the present invention is to provide a centerline detector for a tubular knit fabric lay cutter table. The apparatus includes: (a) a nearside side edge compressor for determining the position of the nearside edge of the fabric lay and providing a signal representative of the nearside edge; (b) a farside side edge compressor for determining the position of the farside edge of the fabric lay and providing a signal representative of the farside edge; and (c) a controller connected to the nearside side edge compressor and the farside side edge compressor for receiving the signal representative of the nearside edge and the signal representative of the farside edge and calculating a first centerpoint of the fabric lay.

Another aspect of the present invention is to provide a centerline detector for a tubular knit fabric lay cutter table. The apparatus includes: (a) a nearside side edge compressor for determining the position of the nearside edge of the fabric lay and providing a signal representative of the nearside edge, the nearside compressor including a first generally vertical movable paddle and an actuator for moving the first paddle against the nearside edge of the fabric lay at a predetermined pressure; (b) a farside side edge compressor for determining the position of the farside edge of the fabric lay and providing a signal representative of the farside edge, the farside compressor including a second generally vertical movable paddle and an actuator for moving the second paddle against the farside edge of the fabric lay at substantially the same predetermined pressure as the first paddle; and (c) a controller connected to the nearside side edge compressor and the farside side edge compressor for receiving the signal representative of the nearside edge and the signal representative of the farside edge and calculating a first centerpoint of the fabric lay.

Still another aspect of the present invention is to provide a centerline detector for a tubular knit fabric lay cutter table. The apparatus includes: (a) a nearside side edge compressor for determining the position of the nearside edge of the fabric lay and providing a signal representative of the nearside edge, the nearside compressor including a first generally vertical movable paddle and an actuator for moving the first paddle against the nearside edge of the fabric lay at a predetermined pressure; (b) a farside side edge compressor for determining the position of the farside edge of the fabric lay and providing a signal representative of the farside edge, the farside compressor including a second generally vertical movable paddle and an actuator for moving the second paddle against the farside edge of the fabric lay at substantially the same predetermined pressure as the first paddle; (c) a controller connected to the nearside side edge compressor and the farside side edge compressor for receiving the signal representative of the nearside edge and the signal representative of the farside edge and calculating a first centerpoint of the fabric lay; and (d) a plastic film tucker upstream from the centerline detector for tucking the edges of the plastic film against the nearside edge and the farside edge of the fabric lay to prevent interference with the operation of the centerline detector.

These and other aspects of the present invention will become apparent to those skilled in the art after a reading of the following description of the preferred embodiment when considered with the drawings.

DESCRIPTION OF THE PREFERRED EMBODIMENTS

Figure 1:
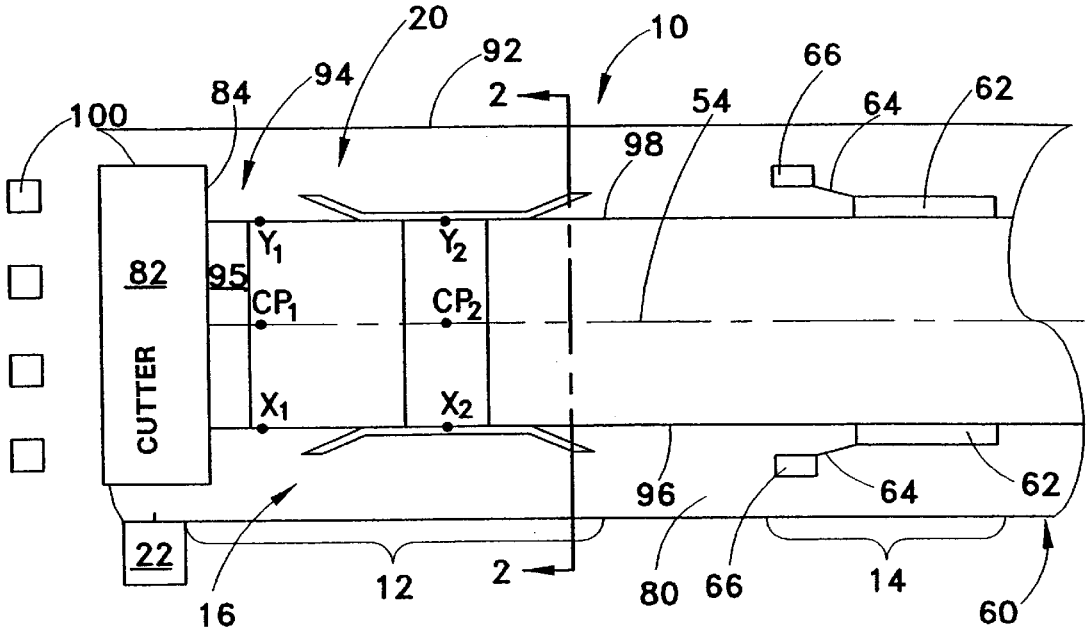
FIG. 1 is a top view of a tubular knit fabric centerline detector constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a tubular knit fabric centerline detector for a tubular knit fabric lay cutter, generally designated 10, is shown constructed according to the present invention.

The tubular knit fabric centerline detector 10 comprises a centerline detector 12 for detecting the centerline 54 of a tubular knit fabric lay 76 having a multiplicity of tubular knit fabric plies 74 longitudinally controllable and movable via forced air (not shown) directed upward through holes (not shown) in a float table 80. The tubular knit fabric lay 76 is movable along the float table 80 with respect to a table edge 92 for cutting downstream by a cutter 82 on a cutter table 94. As the tubular knit fabric lay 76 is pulled longitudinally along the float table 80, a plastic film 90 is positioned on top of the fabric lay 76 to stabilize the fabric lay during cutting.

In a preferred embodiment, the tubular knit fabric lay 76 is covered with a plastic film 90 upstream from the cutter 82. The fabric lay 76 and plastic film 90 are moved downstream toward the centerline detector 12 on the float table 80 having a horizontal float table surface (as seen in FIG. 1) with holes therein (not shown) and a multiplicity of fans (not shown) for forcing air upwardly through the float table holes thereby decreasing friction between the fabric lay 76 and the float table horizontal surface 80. When the fabric lay 76 and plastic film 90 combination move downstream to the cutter table 94, a vacuum source (not shown) applies vacuum through openings (not shown) in a cutter table horizontal surface 95 for releasably securing the tubular knit fabric lay 76 and the plastic film 90 to the cutter table surface 95 while the cutter 82 cuts through the tubular knit fabric lay 76 and the plastic film 90 to form tubular knit fabric garment piece sections 100.

In a preferred embodiment, the centerline detector 12 further comprises a nearside side edge compressor 16 for compressibly determining a first nearside position X1, and a second nearside position X2 of a fabric lay nearside edge 96; a farside side edge compressor 20 for compressibly determining a first farside position Y1, and a second farside position Y2 of a fabric lay farside edge 98; and a controller 22 in electrical connection to each of the edge compressors 16, 20 for automatically calculating the longitudinal centerline 54 of the tubular knit fabric lay 76 along the entire length thereof.

More preferably, the centerline detector 12 includes a controller 22 for automatically determining the centerline 54 of a tubular knit fabric lay 76 as the line formed between a first centerpoint position CP1 and a second centerpoint position CP2. The first centerpoint position 40 is preferably calculated as CP1=[X1+(X1+Y1)/2] and the second centerpoint position 52 is preferably calculated as CP2=[X2+(X2+Y2)/2]. Further, the controller 22 automatically determines either the centerline 54 and/or the centerline angle 56 formed between the centerline 54 and the cutter frame upstream edge 84.

Figure 2:
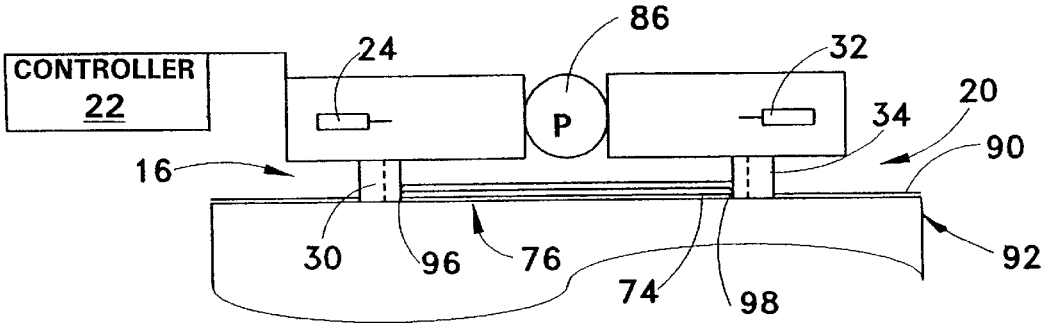
FIG. 2 is a cross-sectional view of the tubular knit fabric centerline detector shown in FIG. 1, taken along lines 2—2.

Referring now to FIG. 2, in a preferred embodiment, the nearside side edge compressor 16 further includes a nearside paddle 30 attached to and positionable by a nearside actuator 24 for determining a first nearside position value X1 (FIG. 1). Similarly, in a preferred embodiment, the farside side edge compressor 20 further includes a farside paddle 34 attached to and positionable by a farside actuator 32 having an equal pressure to the nearside actuator for determining a first farside position value Y1 (FIG. 1). Also preferably the actuators 24, 32 are pneumatic. Preferably the first nearside and farside position values X1, Y1, respectively, are determined by respective LVDTs connected to actuators 24, 32.

Further, the centerline detector 12 may include drive means for moving the nearside and farside side edge compressors 16, 20, respectively, upstream for measuring a second nearside position value X2 and a second farside position value Y2. In the preferred embodiment, the detector 12 is attached to the cutter frame which may be moved to make multiple measurements along the length of the fabric lay.

As best seen in FIG. 2, in a preferred embodiment, the centerline detector 12 further includes a gauge 86 for displaying the centerline pressure value 54. For example, when pneumatic actuators are used, about 5 psi is sufficient pressure to determine the edges of the fabric lay. The gauge 86 helps the operator to prevent excessive pressure being applied which could cause distortion of the edges of the fabric lay.

Also, in a preferred embodiment, the tubular knit fabric lay 76 and the plastic film 90 move longitudinally along the float table 80 toward the cutter downstream and pass between a plastic film tucker 14 which forces the plastic film 90 into contact with the fabric lay nearside edge 96 and the fabric lay farside edge 98 thereby eliminating substantial gaping or "tenting" between the plastic film 90 and the fabric lay edges 96, 98 and minimizing measurement error downstream at the centerline detector 12.

Additionally, in a preferred embodiment, the plastic film tucker 14 is removably attached to the float table frame 60 and includes a pair of opposed guide plates 62 having respective flared inlets 64 for gradually guiding the fabric lay 76 and plastic film 90. Further, in a preferred embodiment, the plastic film tucker 14 includes a pair of rollers 66 attached to each of the opposed guide plates 62 at the respective inlets 64 for forcing the plastic film 90 into contact with the fabric lay nearside and farside edges 96, 98, respectively. In another preferred embodiment, the pair of rollers 66 are removably positioned upstream from the pair of opposing guide plates 62.

In operation, the nearside side edge compressor 16 is moved against the edge of the fabric lay 76 to determine the position of the nearside edge 96 of the fabric lay and provide a signal representative of the nearside edge. At about the same time, the farside side edge compressor 20 is moved against the edge of the fabric lay to determine the position of the farside edge 98 of the fabric lay and provide a signal representative of the farside edge. The controller connected to the nearside side edge compressor and the farside side edge compressor receives the signal representative of the nearside edge and the signal representative of the farside edge and calculates a first centerpoint CP1 of the fabric lay. In the preferred embodiment the centerline detector makes at least two measurements CP1, CP2 along a length of the fabric lay. The multiple measurements of the centerpoint of the fabric lay can then be used to calculate the centerline of the fabric lay between the two points as well as the centerline angle with respect to the edge of the cutter table 94. This information can be used by the cutter table to adjust the layout of the fabric garment pieces that the cutter will be used to cut.

Certain modifications and improvements will occur to those skilled in the art upon a reading of the foregoing description. By way of example, other types of controlled pressure actuators could be used instead of pneumatic cylinders. Also, while plastic film is usually used to stabilize the fabric lay for cutting, other materials, such as paper, could be used. Finally, the opposed guide plates may not be needed when the fabric rollers are positioned upstream before the vacuum section of the cutter bed. It should be understood that all such modifications and improvements have been deleted herein for the sake of conciseness and readability but are properly within the scope of the following claims.

I claim:

1. A centerline detector for a tubular knit fabric lay cutter table, said centerline detector comprising:

(a) a nearside side edge compressor for determining the position of a nearside edge of fabric lay on said table and providing a signal representative of said nearside edge;

(b) a farside side edge compressor for determining the position of a farside edge of said fabric lay and providing a signal representative of said farside edge; and (c) a controller connected to said nearside side edge compressor and said farside side edge compressor for receiving said signal representative of said nearside edge and said signal representative of said farside edge and calculating a first centerpoint of said fabric lay.

2. The centerline detector according to claim 1, further including a plastic film tucker upstream from said centerline detector for tucking edges of plastic film against said nearside edge and said farside edge of said fabric lay to prevent interference with the operation of said centerline detector.

3. The centerline detector according to claim 2, wherein said plastic film tucker includes a frame attached to said cutter table and a pair of opposed guide plates attached to said frame adjacent to said fabric lay.

4. The centerline detector according to claim 3, wherein each of said pair of opposed guide plates includes an inlet attached to said frame adjacent to said fabric lay, wherein said inlet is flared to aid in tucking said plastic film against the edges of said fabric lay.

5. The centerline detector according to claim 3, further including a pair of rollers downstream from said pair of opposed guide plates adjacent to said fabric lay to aid in tucking said plastic film against the edges of said fabric lay.

6. The centerline detector according to claim 5, wherein said pair of rollers downstream from said pair of opposed guide plates adjacent to said fabric lay are each attached to an inlet of one of said pair of opposed guide plates.

7. A centerline detector for a tubular knit fabric lay cutter table, said centerline detector comprising:

(a) a nearside side edge compressor for determining the position of a nearside edge of fabric lay on said table and providing a signal representative of said nearside edge, the nearside compressor including a first generally vertical movable paddle and an actuator for moving the first paddle against the nearside edge of said fabric lay at a predetermined pressure;

(b) a farside side edge compressor for determining the position of a farside edge of said fabric lay and providing a signal representative of said farside edge, the farside compressor including a second generally vertical movable paddle and an actuator for moving the second paddle against the farside edge of said fabric lay at substantially the same predetermined pressure as said first paddle; and (c) a controller connected to said nearside side edge compressor and said farside side edge compressor for receiving said signal representative of said nearside edge and said signal representative of said farside edge and calculating a first centerpoint of said fabric lay.

8. The centerline detector according to claim 7, wherein the actuators are pneumatic cylinders.

9. The centerline detector according to claim 7, wherein the compressors include LVDTs attached to the actuators for providing the signals representative of the nearside and farside edges.

10. The centerline detector according to claim 7, further including means for moving said centerline detector to a second position upstream of said cutter table to calculate a second centerpoint of said fabric lay.

11. The centerline detector according to claim 10, wherein said controller calculates a centerline of said fabric lay between the first and second centerpoint of said fabric lay.

12. The centerline detector according to claim 11, wherein said controller calculates a centerline angle of said fabric lay between said first and second centerpoint of said fabric lay with respect to an edge of said cutter table.

13. A centerline detector for a tubular knit fabric lay cutter table, said centerline detector comprising:

(a) a nearside side edge compressor for determining the position of a nearside edge of fabric lay on said table and providing a signal representative of said nearside edge, the nearside compressor including a first generally vertical movable paddle and an actuator for moving the first paddle against the nearside edge of said fabric lay at a predetermined pressure;

(b) a farside side edge compressor for determining the position of a farside edge of said fabric lay and providing a signal representative of said farside edge, the farside compressor including a second generally vertical movable paddle and an actuator for moving the second paddle against the farside edge of said fabric lay at substantially the same predetermined pressure as said first paddle;

(c) a controller connected to said nearside side edge compressor and said farside side edge compressor for receiving said signal representative of said nearside edge and said signal representative of said farside edge and calculating a first centerpoint of said fabric lay; and (d) a plastic film tucker upstream from said centerline detector for tucking edges of plastic film against said nearside edge and said farside edge of said fabric lay to prevent interference with the operation of said centerline detector.

14. The centerline detector according to claim 13, wherein said plastic film tucker includes a frame attached to said cutter table and a pair of opposed guide plates attached to said frame adjacent to said fabric lay.

15. The centerline detector according to claim 14, wherein each of said pair of opposed guide plates includes an inlet attached to said frame adjacent to said fabric lay wherein said inlet is flared to aid in tucking said plastic film against the edges of said fabric lay.

16. The centerline detector according to claim 14, further including a pair of rollers downstream from said pair of opposed guide plates adjacent to said fabric lay to aid in tucking said plastic film against the edges of said fabric lay.

17. The centerline detector according to claim 16, wherein said pair of rollers downstream from said pair of opposed guide plates adjacent to said fabric lay are each attached to an inlet of one of said pair of opposed guide plates.

18. The centerline detector according to claim 13, wherein the actuators are pneumatic cylinders.

19. The centerline detector according to claim 13, wherein the compressors include LVDTs attached to the actuators for providing the signals representative of the nearside and farside edges.

20. The centerline detector according to claim 13, further including means for moving said centerline detector to a second position upstream of said cutter table to calculate a second centerpoint of said fabric lay.

21. The centerline detector according to claim 20, wherein said controller calculates a centerline of said fabric lay between the first and second centerpoint of said fabric lay.

22. The centerline detector according to claim 21, wherein said controller calculates a centerline angle of said fabric lay between said first and second centerpoint of said fabric lay with respect to an edge of said cutter table.

* * * * *